United States Patent [19]

Morris et al.

[11] 4,114,347

[45] Sep. 19, 1978

[54] CAPPING APPARATUS HAVING MEANS FOR CONVEYING CONTAINERS WHILE SUSPENDED BY A FLANGE

[75] Inventors: Frank R. Morris, Yardley; Alfred C. Alberghini, Langhorne, both of Pa.

[73] Assignee: Pepsico, Inc., Purchase, N.Y.

[21] Appl. No.: 795,280

[22] Filed: May 9, 1977

[51] Int. Cl.[2] ..... B65B 7/28
[52] U.S. Cl. ..... 53/300; 198/481
[58] Field of Search ..... 53/300, 314, 331.5, 53/291; 198/481

[56] References Cited

U.S. PATENT DOCUMENTS

| | | | |
|---|---|---|---|
| 1,463,998 | 8/1923 | Hippenmeyer et al. | 53/300 X |
| 1,726,479 | 8/1929 | Engle | 53/300 X |
| 1,912,677 | 6/1933 | Williams | 53/300 |
| 3,432,989 | 3/1969 | Bouzereau | 53/300 X |
| 3,875,725 | 4/1975 | Carmichael | 53/300 X |
| 4,013,496 | 3/1977 | Amberg | 53/291 X |

*Primary Examiner*—Horace M. Culver
*Attorney, Agent, or Firm*—Bernard & Brown

[57] ABSTRACT

Apparatus for capping containers having a relatively rigid capping portion and an outwardly extending flange. The containers, which are preferably made of resilient thermoplastic material, are suspended from their flange while being capped.

7 Claims, 2 Drawing Figures

Figure 1:
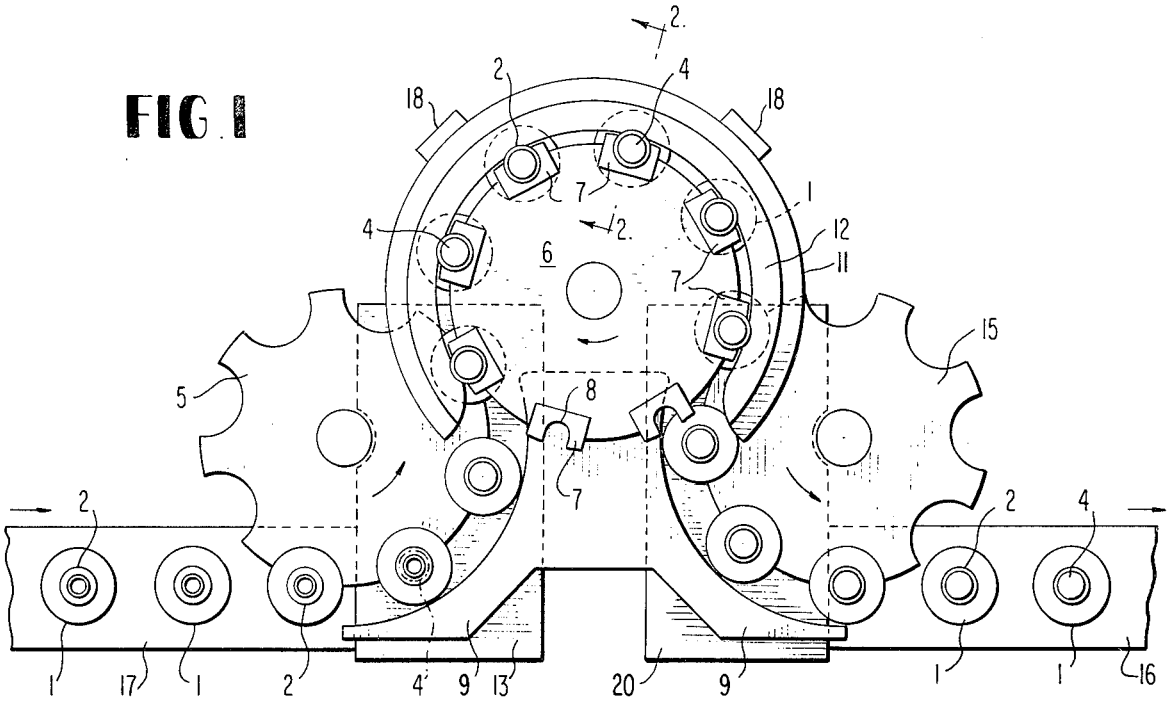

CAPPING APPARATUS HAVING MEANS FOR CONVEYING CONTAINERS WHILE SUSPENDED BY A FLANGE

This invention relates to apparatus which is useful for capping containers including those for holding liquids under elevated pressure such as soft drinks, beer, and other liquids.

Containers used to hold liquids under elevated pressure, for example, carbonated beverages such as soft drinks, soda water or beer, must be tightly sealed to constrain the autogenous pressure in the container. These containers have a relatively thick, rigid capping portion and may be provided with a lower or body portion which is generally a thin-walled structure which may be relatively rigid or resilient. The containers have self-supporting walls with the capping portion being at the top when the containers are in the upright position. The cap is positioned on the capping portion and sealed on the container by exerting a relatively large compressive force against the cap along the axis of the container sufficient to force the cap tightly onto the container. The capping device may form threads on the cap to conform to the shape of threads on the capping portion of the container.

In the operation of various capping devices, the downward thrust of the capper exerts a relatively large pressure on the thin-walled container which is standing on its base, and the container may buckle or rupture if it has resilient sides or shatter if they are fairly rigid. Although the containers, which are preferably made of plastic or polymeric material, may have sufficiently thick walls to be strong enough to withstand such capping loads without damage, the cost of such containers is frequently prohibitive. It is usually desirable to use less of the polymer material and provide a relatively thin-walled container whose walls may not be able to withstand the capping force required to place the cap on the container in tight, sealing engagement.

The walls of typical thin-walled containers may be at least about 10 mils, often about 10 to 50 mils, thick in the body portion. The capping portion of such containers is frequently provided with an outwardly or circumferentially enlarged portion or flange having walls which are generally as thick as, or preferably thicker than, the capping portion. The flange is provided as an aid for pouring liquid from a large container, such as the 64 ounce size, when it is opened. This generally horizontally-disposed flange can also be engaged during the capping operation, and thereby absorb some of the capping force to prevent undue distortion or rupture of the container.

U.S. Pat. No. 3,875,725 discloses an apparatus for capping relatively lightweight, thin-walled plastic bottles having a flange or their neck. During capping, the bottles are placed on a carrier and received by a device comprising a carousel supporting two opposing, pivoting jaws at each bottle-receiving position. The jaws are opened to receive a bottle and closed as the bottle is positioned for capping. The cap is applied to the capping portion of the bottle using an axial compressive force which is absorbed by the bottle in depressing the flange against the closed jaws. This apparatus, is however, disadvantageous since the movement and position of the jaws must be controlled to insure that the containers are properly fed into capping position. Moreover, the downward force applied to the containers to engage their flange with the upper surface of the jaws may cause damage to or even destroy the containers.

Although with adequate care in forming the containers and in designing and operating the equipment shown in the aforementioned patent, the flange can be fed into the moveable jaws with only slight clearance between the lower surface of the flange and the upper surface of the jaws so that less than the total capping force is absorbed by the thin walls of the containers before their flanges become supported by the jaws, it may be advisable to have greater vertical spacing in this respect to insure that the flange does not jam the jaws and thereby cause severe machine damage. When this vertical space is, however, increased, greater force must be applied to the thin walls of the container in order for its flange to reach engagement with the jaws. As a consequence, the containers are more likely to be damaged or destroyed during capping.

The present invention provides an improved apparatus useful for capping containers having a relatively rigid capping portion with an outwardly extending support or flange. The apparatus is capable of capping such bottles at relatively high speeds with good reliability and without becoming jammed or damaged or experience other mechanical failure. The apparatus of the invention is particularly useful for capping containers having relatively thin, resilient walls and which may be made of plastic material, and capping can be accomplished by exerting little, if any, force on the thin walls of the containers.

According to this invention, the containers, e.g., bottles, are fed to a rotatable means, e.g., a carousel, equipped on its periphery with a plurality of container holders having outwardly facing, open portions that receive the containers and provide support for the underside of an inwardly positioned portion of the container flange. These holders are preferably fixedly attached to the rotatable means and may be formed as a part thereof. The containers are fed sequentially into the holders with the enlarged flange of the containers positioned above the support, and when the containers are placed in the holders a portion of the flange extends outwardly beyond the support. During feeding into the holders, the containers are resting upright on a support. Rotation of the container receiving member from the feeding position transports the base-supported containers to a stationary support that is spaced outwardly of the rotatable member and is positioned to fit beneath the underside of the outwardly extending flange portion of the containers. The containers remain supported on their base until their flanges are above the outwardly positioned, stationary, flange support. Then the rotatable means carries the containers off of their base support, and as a result, the containers drop slightly and become suspended by their flange which is resting on a respective holder of the rotatable means and the outward, stationary, flange support. The stationary support of the device of the present invention extends around a substantial portion of the periphery of the rotatable member for a distance sufficient to provide adequate time for capping the containers while the latter are in the suspended position. The spacing of the stationary support away from the rotatable member is adequate to permit movement of the containers between these members while the containers are being capped. The position of the outward, stationary support may result in its collision with the container flange should the underside of the flange be below the upper surface of the support for the inward portion of the flange as the containers are fed into the capping device. As a result, containers that are rejected by or not properly positioned in the holders of the rotating container-receiving means may be expelled from the capping operation, by, for instance, the collision of the flange with the outward, stationary support shearing the capping portion from the container. Even in such event, the capping operation is not interrupted.

A capping device caps the containers by the application of an axial force when the inward and outward portions of the flange of the containers are in the supported position. Since, at such time, the bottles are suspended from their flange, essentially all of the capping force is absorbed by the flange and none is applied to the thin walls of the containers, even when the containers are fed into the capping device with the container flange at a relatively high position to insure that the flanges are initially spaced above the holders on the rotatable members in spite of normal variations in container dimensions and equipment operation. After capping, the containers are removed from their holders before the holders return to the container-feeding position.

Thin-walled plastic containers which may preferably be capped in accordance with this invention may be made from various suitable plastic materials. Although the containers may have relatively rigid walls, it is preferred that the containers be made of resilient thermoplastic material. These materials include, for example, olefin polymers such as high density or low density polyethylene and polypropylene, which may be atactic or isotactic. Other useful thermoplastic materials include polyesters such as polyethylene terephthalate; vinyl polymers, e.g., polystyrene, polyvinyl chloride, polyacrylates or polymethacrylates; and polynitriles such as the acrylonitrile and methacrylonitrile polymers. The polymers may be in homopolymer or copolymer form as in the case, for instance, of copolymers of methacrylonitrile or acrylonitrile and one or more of styrene and olefinically-unsaturated carboxylic acids such as acrylic acid and methacrylic acid.

The neck portion of thermoplastic bottles is generally a substantially thicker and more rigid structure than the sides and bottom of the bottles. The neck portion, and thus the flange described above, can be formed by injection molding in the desired thickness. Due to the strength of the flange, it is necessary only to support a portion of the periphery of the flange during capping.

Figure 2:
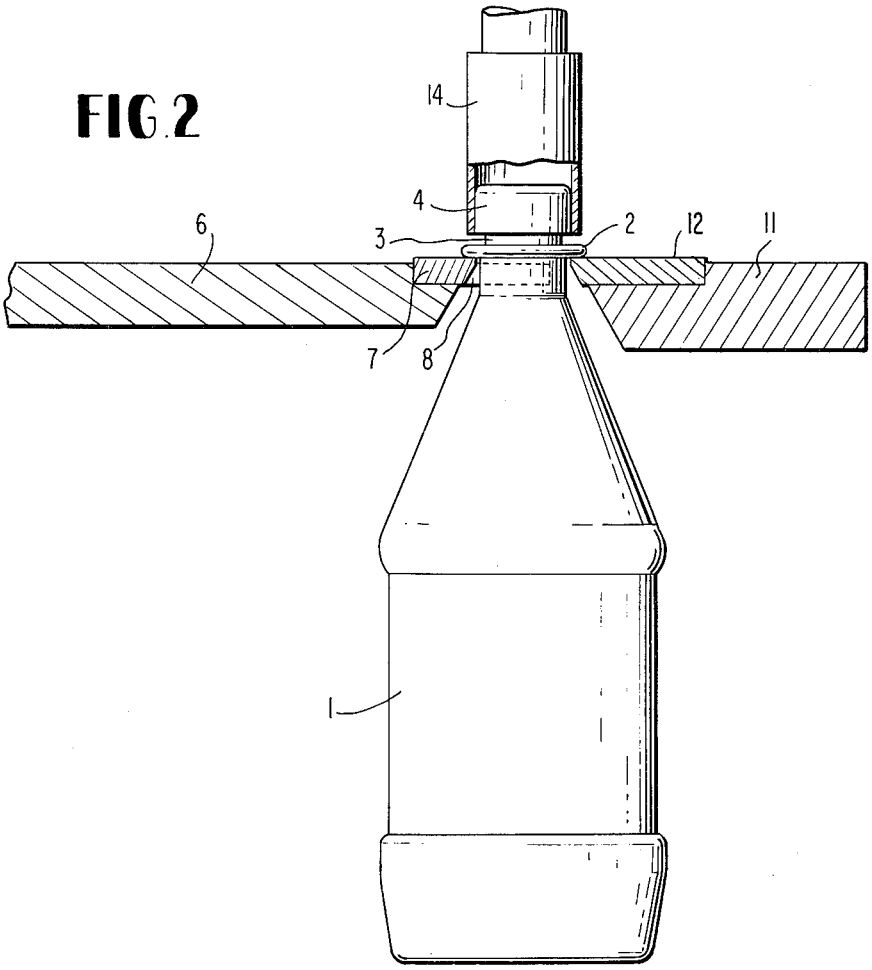

The above and other advantages, features and characteristics of this invention will be described in further detail by reference to the accompanying drawings in which, FIG. 1 is a plan view of one embodiment of a carousel-type capping apparatus of this invention showing the positioning of bottles and container holders below the capping heads; and FIG. 2 is a side, fragmentary view taken along line 2—2 of FIG. 1 showing the cap being attached by a capping head.

Liquid-filled, resilient, thermoplastic bottles 1, each of which has a horizontally-enlarged, solid flange 2 and a cap 4 loosely positioned by gravity feed on its capping portion 3, are moved by a conveyor 17 into a starwheel 5 which, along with stationary guide 9, feeds the bottles sequentially onto a carousel or rotating center ring 6. Starwheel 5 is mounted in a plane below rotating center ring 6 and above a stationary table 13 positioned to support the base of the bottle as it rotates in starwheel 5. Thus, starwheel 5 engages the large side wall of the bottle and slides the bottle on its base on table 13. Carousel 6 has a plurality of container holders 7, for example, about 4 to 24, that are in equally-spaced positions around its periphery. Each container holder 7 has an outwardly facing open portion 8 that receives one of the bottles 1 as it is fed into the container holder. Normally, the positioning of the elements of the apparatus is coordinated with the usually expected height of filled bottles 1 so that the underside of flange 2 is above, e.g., at least about 0.01 inch, the upper surface of holder 7 to insure the placing of the bottles supported on table 13 within holders 7 so that the inwardly positioned underside of flange 2 is spaced at least slightly above holder 7. If necessary, when modifying existing equipment in order to have the bottles at an appropriate height, stationary table 13 may be equipped with an upwardly inclined ramp positioned below starwheel 5 to raise flange 2 above the container holder 7.

Rotation of carousel 6 in a clockwise direction moves bottle 1 from its initial position within its holder 7 to a position where the outer side of the container flange is above a stationary supporting collar 12, but the bottle remains on table 13. Collar 12 is positioned on base 11 which is held by supports 18 extending downwardly to the floor or other supporting base. As the rotation of member 6 continues, the base of the bottle 1 slides off table 13. The bottle then drops downwardly in holder 7 so that the inwardly positioned underside of flange 2 moves into contact with the upper surfaces of its holder 7 and collar 12, and the bottle thereby becomes freely suspended. The upper surfaces of holder 7 and collar 12 thus support the underside of both the inwardly and outwardly positioned portions of flange 2. Open portions 8 are preferably substantially U-shaped and are sized to freely accommodate and receive the neck portion of the bottles and to fit underneath the inwardly positioned portion of flange 2. Since the underside of flange 2 on the bottles being fed to holders 7 is normally spaced above holder 7 and collar 12, the resulting clearance allows for minor variations in the vertical distance between the bottom of the flanges 2 and the top of holders 7 without having a bottle rejected by its flange hitting holder 7 and collar 12.

Collar 12 extends around a substantial portion of the periphery of carousel 6 sufficient to allow time for the capping of bottles 1 while they are suspended by their flanges on holders 7 and collar 12. During capping, a substantial axial force is exerted on the upper end of the containers. The capping portion of the containers is thick enough to withstand such force without significant deformation. Since the capping force is applied to bottles 1 while they are suspended by their flange, the thin-walls of the containers do not receive a material amount, if any, of the capping force.

Collar 12 is spaced outwardly from holders 7 and carousel 6 a sufficient distance to permit passage of the necks of bottles 1 between carousel 6 and collar 12 as the containers are being capped. Collar 12 is preferably a circularly-shaped, stationary member which is vertically positioned in relation to carousel 6 and holders 7 for the collar 12 to fit beneath flange 2 and provide support therefor. Generally, the upper surfaces of holders 7 and collar 12 are in substantially the same horizontal plane. If the upper surface of collar 12 is significantly above that of holders 7, the necks of the bottles may be damaged during capping, while if the collar is too low, the caps may not be properly applied to the bottles.

The bottles are capped by engagement of a capping head 14 with cap 4 resting on the top of the bottle. Capping head 14 engages the bottles after they become supported on collar 12 and a given bottle leaves table 13, and the axial force applied to the capping portion of the bottles is taken up by the flanges 2. Capping head 14 seals the cap 4 on the bottles by applying an axial compressive force. The capping occurs as the bottles move along the length of collar 12 by rotation of carousel 6. As the end of collar 12 is approached, capping head 14 is withdrawn from the bottles which pass onto table 20 and become supported thereby. As the bottles exit from collar 12, starwheel 15 engages the sides of the bottles and removes them with the help of guide 9 from container holders 7 onto a moving conveyor 16. The container holders 7 then return to the container-feeding position.

The apparatus of the invention affords a simple convenient manner of capping flanged containers without encountering operating difficulties. Since the means provided for supporting the containers during capping need not undergo pivotal engagement, a highly reliable operation is provided. The containers can be capped without the application of any additional force on their walls, even when the filled containers are fed into the operation at a height which insures their proper handling during the capping operation.

It is claimed:

1. An apparatus for capping containers having a capping portion with a horizontally-enlarged flange, by the application of axial force to the capping portion of the containers, which comprises rotatable means having a plurality of container holding means positioned on the periphery of said rotatable means, said holding means having an outwardly facing open portion for receiving the containers, and providing first supporting means for supporting the underside of an inwardly positioned portion of the enlarged flange of the containers with a portion of the flange extending outwardly of said first supporting means, means for feeding the containers sequentially into said holding means so that the horizontally-enlarged flange on the capping portion of the containers is above said first supporting means, second stationary supporting means positioned outwardly of said rotatable means with a space therebetween, said rotatable means being suitable for transporting the containers on said first supporting means to said second stationary supporting means, means for supporting the lower portion of the containers as they move from said feeding means into the space between said rotatable means and said second supporting means, said first and second supporting means serving to suspend said containers by said flange and between said first and second supporting means, said second supporting means being spaced outwardly of said rotatable means opposite a substantial portion of the periphery of the rotatable means sufficient to permit capping of the containers while they are supported on and suspended from said first and second supporting means, said spacing being sufficient to permit movement of the containers between said rotatable means and said second supporting means as the containers are capped, means for capping said containers by the application of axial force when the containers are supported on and suspended from said first and second supporting means, said first and second supporting means being spaced relative to one another for engaging said flange to receive substantially all of said axial force applied by said means for capping said containers while simultaneously permitting said movement of said containers therebetween, and means for removing capped containers from said holding means before said holding means return to the container-feeding position.

2. The apparatus of claim 1 wherein the outwardly facing portions of said container holding means are substantially U-shaped and the container holding means are equally-spaced around the periphery of the rotatable means.

3. The apparatus of claim 1 wherein the outward supporting means is a stationary collar extending around a substantial portion, but not all, of the periphery of said rotatable means.

4. The apparatus of claim 1 wherein said holding means are fixedly positioned on said rotatable means.

5. An apparatus for capping containers having a capping portion with a solid horizontally-enlarged flange, by the application of axial force to the capping portion of the containers, which comprises rotatable means having a plurality of container holding means fixedly positioned on said rotatable means and equally spaced around the periphery of said rotatable means, said holding means having an outwardly facing, substantially U-shaped open portion for receiving the containers, and providing first supporting means for supporting the underside of an inwardly positioned portion of the enlarged flange of the containers with a portion of the flange extending outwardly of said first supporting means, means for feeding the containers sequentially into said holding means with the horizontally-enlarged flange on the capping portion of the containers being spaced above the upper surface of said first supporting means, a stationary collar positioned outwardly of said rotatable means with a space therebetween, said stationary collar having an upper surface for supporting the underside of the outwardly positioned portion of the enlarged flange of the containers on substantially the same horizontal plane as said first supporting means, said rotatable means being suitable for transporting the containers in said first supporting means to said stationary collar, means for supporting the lower portion of the containers as they move from said feeding means into the space between said rotatable means and said collar, said first supporting means and said collar serving to suspend said containers by said flange, said collar extending outwardly of said rotatable means around a substantial portion, but not all, of the periphery of the rotatable means sufficient to permit capping of the containers while they are supported on and suspended from said first supporting means and said collar, said spacing being sufficient to permit movement of the containers between said rotatable means and said collar as the containers are capped, means for capping said containers by the application of axial force when the containers are supported on and suspended from said first supporting means and said collar, said collar and said first supporting means being spaced relative to one another for engaging said flange to receive substantially all of said axial force applied by said means for capping said containers while simultaneously permitting said movement of said containers therebetween, and means for removing capped containers from said holding means before said holding means return to the container-feeding position.

6. The apparatus according to claim 5 wherein one end of said collar is spaced relative to said rotatable means for colliding with said capping portion when said outwardly positioned portion of said flange is positioned below said upper surface of said collar whereby a misaligned container is ejected from said apparatus.

7. The apparatus according to claim 6 wherein said means for feeding the containers sequentially into said holding means includes a first conveyor and said means for removing capped containers from said holding means includes a second conveyor, said rotatable means and said collar defining a path for movement of said containers displaced laterally from said first conveyor and said second conveyor for facilitating ejection of said misaligned containers by said apparatus to an area away from said conveyors.

* * * * *